US010550497B1

(12) United States Patent
Sunshine et al.

(10) Patent No.: US 10,550,497 B1
(45) Date of Patent: Feb. 4, 2020

(54) WEAVING EQUIPMENT

(71) Applicant: Apple Inc., Cupertino, CA (US)

(72) Inventors: Daniel D. Sunshine, Sunnyvale, CA (US); Andrew L. Rosenberg, Salt Lake City, UT (US); Daniel A. Podhajny, San Jose, CA (US); Didio V. Gomes, Sunnyvale, CA (US); Maurice P. May, Sunnyvale, CA (US)

(73) Assignee: Apple, Inc., Cupertino, CA (US)

( * ) Notice: Subject to any disclaimer, the term of this patent is extended or adjusted under 35 U.S.C. 154(b) by 168 days.

(21) Appl. No.: 15/467,991

(22) Filed: Mar. 23, 2017

Related U.S. Application Data

(60) Provisional application No. 62/342,501, filed on May 27, 2016.

(51) Int. Cl.

| | |
|---|---|
| ***D03J 5/02*** | (2006.01) |
| ***D03D 1/00*** | (2006.01) |
| ***D03D 49/44*** | (2006.01) |
| ***D03D 51/34*** | (2006.01) |
| ***D03J 5/00*** | (2006.01) |
| *D03D 49/50* | (2006.01) |

(52) U.S. Cl.
CPC ..... *D03D 1/0088* (2013.01); *D03D 49/44* (2013.01); *D03D 51/34* (2013.01); *D03J 5/00* (2013.01)

(58) Field of Classification Search
CPC .. D03D 51/34; D03D 47/00; D03D 2700/313; D03D 47/125; D03D 47/24; D03D 47/261; D03D 51/40; D03J 5/00; D03J 2700/14; D03J 2700/16; D03J 5/06; D03J 5/065; D03J 1/00; D03J 5/02; D03J 5/24
See application file for complete search history.

(56) References Cited

U.S. PATENT DOCUMENTS

| | | | | |
|---|---|---|---|---|
| 2,548,052 A * | 4/1951 | Phaneuf | D03J 5/00 | 139/196.4 |
| 3,580,294 A * | 5/1971 | Muller | D03D 51/34 | 139/273 R |
| 3,592,241 A * | 7/1971 | Svaty | D03D 47/40 | 139/438 |
| 3,604,466 A * | 9/1971 | Strauss | D03D 47/26 | 139/1 C |

(Continued)

*Primary Examiner* — Robert H Muromoto, Jr.
(74) *Attorney, Agent, or Firm* — Treyz Law Group, P.C.; G. Victor Treyz; Kendall W. Abbasi

(57) ABSTRACT

Weaving equipment may include warp strand positioning equipment that positions warp strands and weft strand positioning equipment that inserts weft strands among the warp strands to form fabric. The fabric may include insulating strands and conductive strands. The conductive strands may be coupled to electrical devices using solder joints or other conductive connections. During weaving, an electrically controlled shuttle may dispense weft strands between warp strands. The electrically controlled shuttle may include control circuitry and communications circuitry. The communications circuitry may be used to support communications between the control circuitry and equipment external to the shuttle. Movable arms, cutters, heaters, soldering devices, strand dispensers, intertwining devices, and other electrically controlled devices may be incorporated into the shuttle and controlled by control signals from the control circuitry.

21 Claims, 18 Drawing Sheets

(56) References Cited

U.S. PATENT DOCUMENTS 3,630,238 A * 12/1971 Strauss ..... D03D 47/26 139/430
3,640,313 A * 2/1972 Strauss ..... D03J 5/065 139/196.3
3,711,627 A 1/1973 Maringulov
3,724,508 A * 4/1973 Jekl ..... D03D 47/261 139/196.3
3,750,716 A * 8/1973 Kimura ..... D03D 47/00 139/439
3,945,405 A * 3/1976 Takamatsu ..... A44B 19/54 139/22
4,027,704 A * 6/1977 Romanin ..... D03D 47/00 139/196.2
4,232,714 A * 11/1980 Clokie ..... D03D 37/00 139/134
4,234,021 A * 11/1980 Clokie ..... D03D 51/34 139/371
4,458,726 A * 7/1984 Wenig ..... D03D 51/12 139/11
4,530,113 A * 7/1985 Matterson ..... A61F 2/06 139/387 R
4,892,557 A * 1/1990 Conklin ..... D03D 15/04 139/426 TW
5,048,747 A * 9/1991 Clark ..... H05K 3/3484 228/180.21
5,379,807 A * 1/1995 Kelley ..... D03J 5/24 139/203
5,544,677 A 8/1996 Okubo
5,813,591 A * 9/1998 Quinn ..... B23K 3/063 226/127
7,841,369 B1 10/2010 Osborne
2003/0201360 A1* 10/2003 Hill ..... B65H 81/08 242/443
2004/0055658 A1* 3/2004 Natali ..... D03J 1/005 139/327
2005/0187527 A1 8/2005 Rix
2013/0145588 A1 6/2013 Nakata
2016/0281277 A1* 9/2016 Esponnette ..... D03C 9/0633
2018/0038022 A1* 2/2018 Podhajny ..... D02G 3/441
2018/0178990 A1* 6/2018 Filipovic ..... B65G 47/902
2018/0178991 A1* 6/2018 Filipovic ..... B65G 47/902

* cited by examiner

WEAVING EQUIPMENT

This application claims the benefit of provisional patent application No. 62/342,501, filed May 27, 2016, which is hereby incorporated by reference herein in its entirety.

BACKGROUND

This relates generally to weaving and, more particularly, to equipment for creating woven fabric.

It may be desirable to form electrical devices, enclosures, and other items from fabric. The fabric may contain strands of insulating material and strands of conductive material. In some situations, it may be desirable to form signal paths and other circuitry using the conductive strands. It can be challenging, however, to create desired paths for strands of material in woven fabric. If care is not taken, strands of material will not be routed along desired paths and will not be interconnected as desired.

SUMMARY

Weaving equipment may include warp strand positioning equipment that positions warp strands and weft strand positioning equipment that inserts weft strands among the warp strands to form fabric. The fabric may include insulating strands and conductive strands. The conductive strands may be used to carry power and data signals.

The conductive strands may be coupled to electrical devices in the fabric using solder joints or other conductive connections. During weaving, an electrically controlled shuttle may dispense weft strands between warp strands. The electrically controlled shuttle may include control circuitry and communications circuitry. The communications circuitry may be used to support communications between the control circuitry and equipment external to the shuttle.

The control circuitry may be used to control electrical devices in the shuttle. The control circuitry may, for example, use an electrically controllable gripper in the shuttle to hold onto a conductive warp strand so that the shuttle can adjust the placement of the conductive warp strand within the fabric. The electrical devices controlled by the control circuitry may include grippers, movable arms such as pivoting arms and extending arms with hook-shaped ends, cutters, heaters, soldering tools, strand dispensing and twisting devices, and other devices. Devices that are controlled by the control circuitry and passive structures such as shuttle housing grooves for receiving warp strands during weaving may be incorporated into the shuttle.

DETAILED DESCRIPTION

Electronic devices, enclosures, and other items may be formed from fabric such as woven fabric. The woven fabric may include strands of insulating and conductive material. Conductive strands may form signal paths through the fabric and may be coupled to electrical components such as light-emitting diodes and other light-emitting devices, integrated circuits, sensors, haptic output devices, and other circuitry.

Weaving equipment may be provided with a electronically controlled shuttle. The shuttle may have control circuitry that supplies control signals to electrically controlled components to assist in manipulating warp and weft strands during weaving, to form connections between electrical components and conductive strands, to couple insulating strands to components, to route weft and warp strands to desired locations within a fabric layer, to dispense components, to temporarily grip strands, to control the dispensing of strands of material (e.g., to control tension and/or strand lengths during strand dispensing operations), to apply heat to strands (e.g., to melt away insulating, to form solder joints, etc.), to cut, knot, weld, twist, braid, and otherwise manipulate strands, or to perform other operations during weaving.

Figure 1:
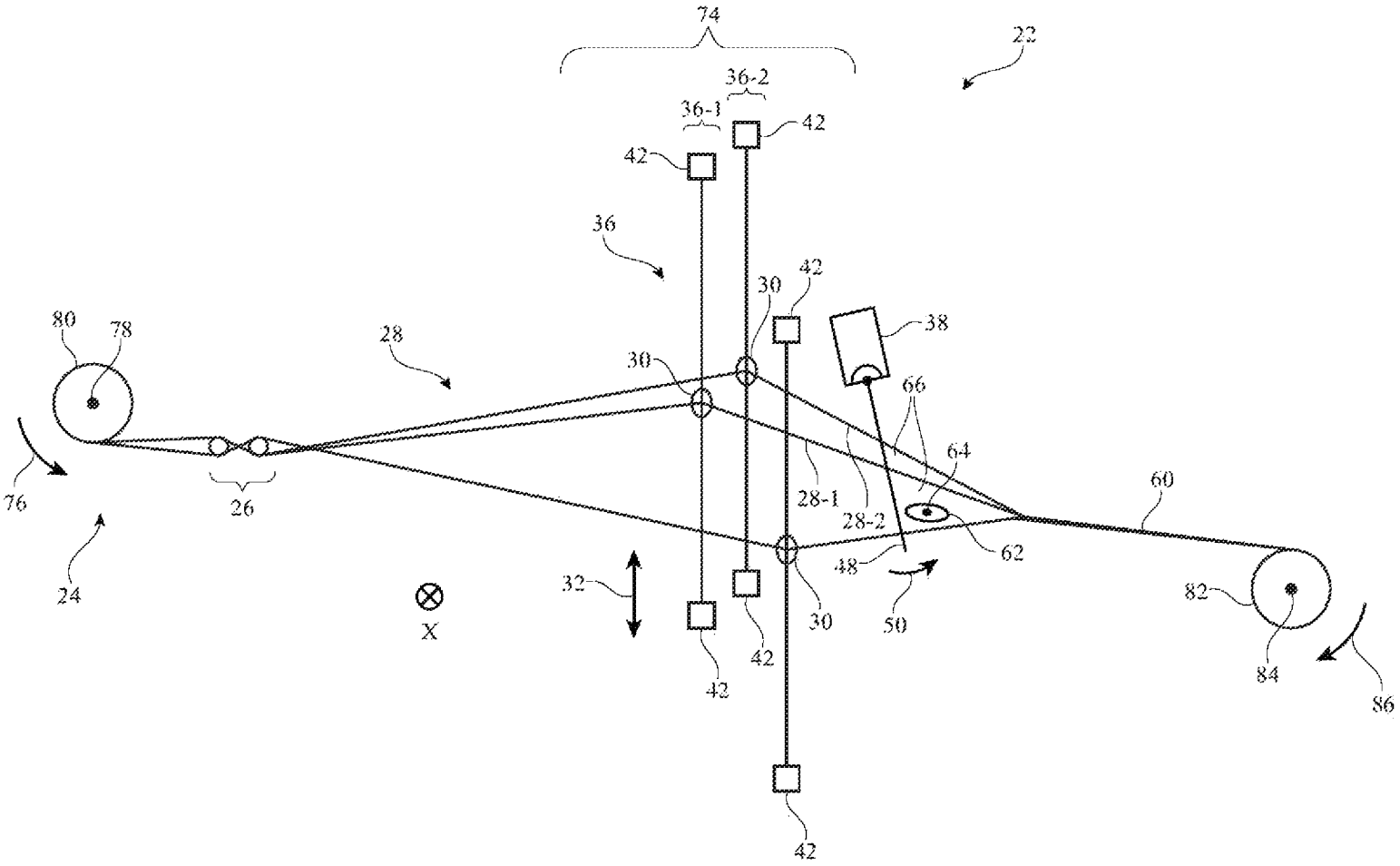
FIG. 1 is a side view of illustrative weaving equipment that may be used to form fabric in accordance with an embodiment.

Illustrative weaving equipment is shown in FIG. 1. Weaving equipment 22 may be used to form fabric 60. The strands of material used in forming fabric 60 may be single-filament strands (sometimes referred to as fibers) or may be threads, yarns, or other strands that have been formed by intertwining multiple filaments of material together. Strands may be formed from polymer, metal, glass, graphite, ceramic, natural strands such as cotton or bamboo, or other organic and/or inorganic materials and combinations of these materials. Conductive coatings such as metal coatings may be formed on non-conductive strands (e.g., plastic cores) to make them conductive. Reflective coatings such as metal coatings may be applied to strands to make them reflective. Strands may also be formed from single-filament metal wire (e.g., bare metal wire), multifilament wire, or combinations of different materials. Strands may be insulating or conductive.

Strands in fabric 60 may be conductive along their entire length or may have conductive segments. Strands may have metal portions that are selectively exposed by locally removing insulation (e.g., to form connections with other conductive strand portions). Strands may also be formed by selectively adding a conductive layer to a portion of a non-conductive strand.). Threads and other multifilament yarns that have been formed from intertwined filaments may contain mixtures of conductive strands and insulating strands (e.g., metal strands or metal coated strands with or without exterior insulating layers may be used in combination with solid plastic strands or natural strands that are insulating).

In general, the strands of material that are intertwined to form fabric 60 may be single filaments of material or may be threads, yarns, or other multifilament strands that have been formed by intertwining multiple single-filament strands. Strands may be formed from insulating materials, conductive materials, and combinations of insulating and conductive materials. The strands that are used in forming fabric 60 may include warp strands 28 and weft strands 64.

Figure 2:
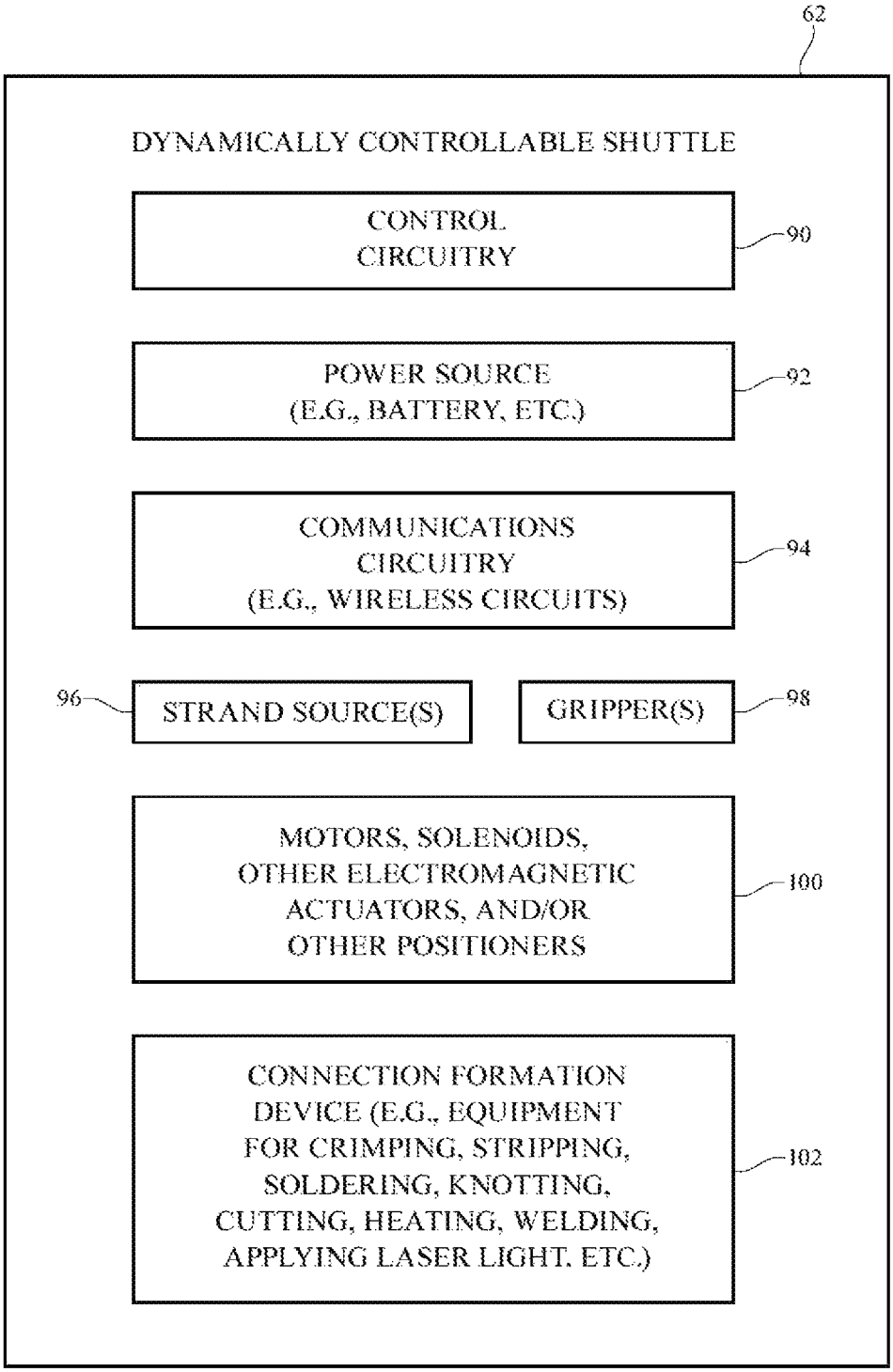
FIG. 2 is a schematic diagram of an electrically controllable shuttle in accordance with an embodiment.

As shown in FIG. 2, weaving equipment 22 includes a warp strand source such as warp strand source 24. Source 24 may supply warp strands 28 from a warp beam or other strand dispensing structure. Source 24 may, for example, dispense warp strands 28 through rollers 26 and other mechanisms as drum 80 rotates about rotational axis 78 in direction 76.

Warp strands 28 may be positioned using warp strand positioning equipment 74.

Equipment 74 may include heddles 36. Heddles 36 may each include an eye 30 mounted on a wire or other support structure that extends between respective positioners 42 (or a positioner 42 and an associated spring or other tensioner). Positioners 42 may be motors (e.g., stepper motors) or other electromechanical actuators. Positioners 42 may be controlled by a controller during weaving operations so that warp strands 28 are placed in desired positions during weaving. In particular, control circuitry in weaving equipment 22 may supply control signals that move each heddle 36 by a desired amount up or down in directions 32. By raising and lowering heddles 36 in various patterns in response to control signals from the control circuitry, different patterns of gaps (sheds) 66 between warp strands 28 may be created to adjust the characteristics of the fabric produced by equipment 22.

Weft strands such as weft strand 64 may be inserted into shed 66 during weaving to form fabric 60. Weft strand positioning equipment 62 may be used to place one or more weft strands 64 between the warp strands forming each shed 66. Weft strand positioning equipment for equipment 22 may include one or more shuttles and/or may include shuttleless weft strand positioning equipment (e.g., needle weft strand positioning equipment, rapier weft strand positioning equipment, or other weft strand positioning equipment such as equipment based on projectiles, air or water jets, etc.). For example, the weft strand positioning equipment of equipment 22 may include an electrically controllable shuttle (shuttle 62) that has control circuitry, actuators, and other electrically controllable devices for processing strands during weaving.

After each pass of weft strand 64 is made through shed 66, reed 48 may be moved in direction 50 by positioner 38 to push the weft strand that has just been inserted into the shed between respective warp strands 28 against previously woven fabric 60, thereby ensuring that a satisfactorily tight weave is produced. Fabric 60 that has been woven in this way may be gathered on fabric collection equipment such as take-down roller 82. Roller 82 may collect woven fabric 60 as roller 82 rotates in direction 86 about rotational axis 84. Reed 48 and shuttle 62 and/or other weft strand positioning equipment may be controlled by the control circuitry that controls heddles 36, so that warp strand position, weft strand positioning, and reed movement can be controlled in a coordinated fashion.

Positioners 42 may be used to control the vertical position of warp strands 28 when forming fabric 60. As shown in FIG. 1, for example, heddle 36-2 may be placed above heddle 36-1, so that warp strand 28-2 is placed above warp strand 28-1. The ability to determine the heights of warp strands 28 within shed 66 during weaving may be used to help determine which warp strands interact with electrically controllable shuttle 62, so that weaving equipment 22 can manipulate conductive and insulating strands within fabric 60. This allows short circuits and open circuits to be selectively formed at various warp-weft strand intersections, allows electrical components to be coupled to the strands, allows conductive structures such as signal paths (e.g., electrodes, data lines, power paths, etc.) to be formed in fabric 60, and allows other fabric structures to be formed. If desired, some of heddles 36 may contain eyes 30 that are mounted on a common wire. The use of independently adjustable heddles is merely illustrative.

A schematic diagram of an illustrative electrically controlled shuttle of the type that may be used in weaving equipment 22 of FIG. 1 is shown in FIG. 2. As shown in FIG. 2, electrically controlled shuttle 62 may include control circuitry such as control circuitry 90. Control circuitry 90 may include processing circuitry such as one or more microprocessors, microcontrollers, digital signal processors, application-specific integrated circuits, and other processors and may include storage such as random access memory, flash storage (e.g., flash disk drives), hard disk drives, and other memory. Control circuitry 90 may run software to control the operation of the components of shuttle 62 during weaving (e.g., to control actuators, etc.). Shuttle 62 may operate autonomously (e.g., by executing preprogrammed instructions) and/or may receive real time commands from external sources (e.g., control circuitry in weaving equipment 22 that is external to shuttle 62). During operation, control circuitry 90 may supply control signals (e.g., analog signals, digital commands, etc.) to control the operation of electrically controllable devices in shuttle 62.

Power source 92 may be used to supply control circuitry 90 and other components in shuttle 62 with power. Power source 92 may include power storage devices such as batteries, capacitors, etc., may include wireless power receiver circuitry for wirelessly receiving power from elsewhere in equipment 22 (i.e., shuttle 62 may include a coil and wireless power receiver to receive transmitted wireless power), may include contacts for receiving power from a bus, or may receive other power source circuitry.

Communications circuitry 94 may be used to transmit information from shuttle 62 to other portions of weaving equipment 22 and/or to external equipment and/or may be used to receive information from equipment 22 or external equipment. For example, sensor data, other data, control information, and other information may be supplied from shuttle 62 to corresponding control circuitry in weaving equipment 22 and/or sensor data, control information, and other information may be supplied from control circuitry in weaving equipment 22 to control circuitry 90 in shuttle 62. Communications circuitry 94 may include antennas and wireless local area network transceiver circuitry (e.g., WiFi® circuitry), Bluetooth® transceiver circuitry, cellular telephone transceiver circuitry, other radio-frequency transceiver circuitry (e.g., circuitry operating in bands from 700 MHz to 2700 MHz, below 700 MHz, above 2700 MHz, or other suitable wireless communications frequencies). If desired, circuitry 94 may include light sources and light detectors for handling wireless communications using light. Communications circuitry 94 may also include wired communications circuitry to support communications between shuttle 62 and external equipment over a wired path (e.g., a cable, a signal bus integrated into a shuttle track, etc.).

Shuttle 62 may include strand source(s) such as strand source(s) 96. Source(s) 96 may include bobbins or other sources of strands of material such as weft strands 64. During operation, shuttle 62 may dispense weft strands 64 between warp strands 28 to form fabric 60. The tension and/or the length of the strands of dispensed material may be monitored and controlled in real time (e.g., using strand sensors, adjustable wheels, and other strand dispensing equipment in strand source(s) 96.

Shuttle 62 may include one or more electrically controlled grippers such as grippers 98. Grippers 98 may be used to temporarily grip warp strands 28, so that warp strands 28 can be moved into a desired position by movement of shuttle 62. Grippers 98 and other movable devices in shuttle 62 may be controlled using electromagnetic actuators or other electrically controllable positioners (e.g., motors, solenoids, other electromagnetic actuators, and/or other positioners 100).

Connection formation components such as connection formation device 102 of FIG. 2 may be used in forming mechanical and/or electrical connections between strands in fabric 60. As an example, device 102 may include equipment for forming crimped connections, equipment for stripping insulation from strands of material (e.g., to expose underlying metal layers), a heating tool for soldering conductive strands to each other, tools for forming knots in strands of material, a cutter for cutting strands, a heating device for applying heat to electrical components, solder joints, conductive strands, and/or other structures, a device for forming welds, a device for applying laser light (e.g., to form welds, to ablate material, etc.), and other electrically controllable components for forming electrical connections between respective conductive strands and performing other strand and component processing tasks. Actuators 100 may be used in equipment 102, grippers 98, strand source 96, and other components in shuttle 62. Actuators 100 and the other components of shuttle 62 may be coupled to control circuitry 90 and may be controlled with control signals supplied by control circuitry 90. Control circuitry 90 may gather sensor data and other data from these electrical components during weaving operations.

Figure 3:
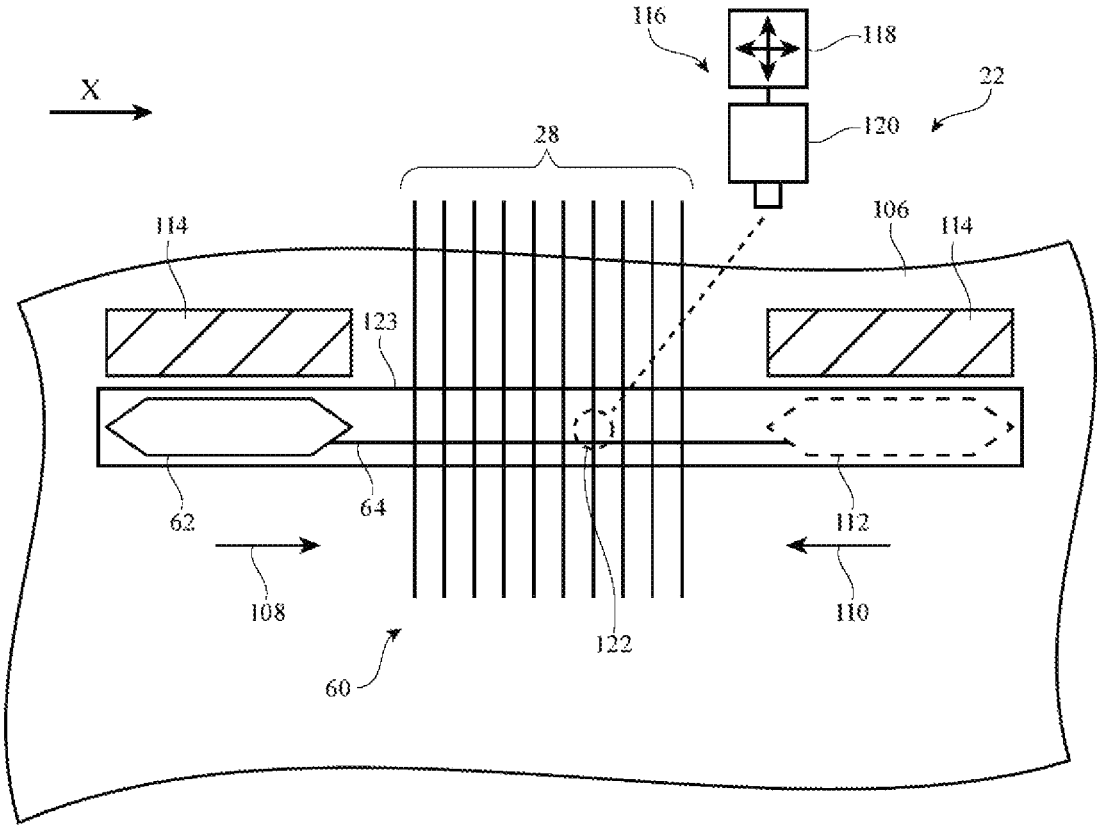
FIG. 3 is a diagram of illustrative weaving equipment with a shuttle in accordance with an embodiment.

FIG. 3 is a diagram of a portion of weaving equipment 22 showing how shuttle 62 may dispense weft strands 64 while moving past warp strands 28 during operation. Shuttle 62 may, for example, be guided along a shuttle track (sometimes referred to as a shuttle box) such as track 123 in shuttle support structure 106 (which may, if desired, be coupled to reed 48). Pneumatic equipment, electromagnetic actuator equipment, or other positioning equipment may be used to move shuttle 62 back and forth in directions 108 and 110 while heddles 36 place each of warp strands 28 in a desired location (e.g., to form shed 66). Shuttle 62 may, for example, be moved from the location shown in FIG. 3 to location 112 (i.e., by moving shuttle 62 in direction 108). During shuttle movement, shuttle 62 may dispense weft strands such as strand 64 into shed 66, which is formed between opposing upper and lower sets of warp strands 28.

Weaving equipment 22 may have equipment such as equipment 114 and 116 for mounting electrical components to warp strands 28 and weft strands 64 and for performing other operations on strands 28 and 64. These operations may, for example, be performed when shuttle 62 is located at the ends of track 123 (as an example). Processing operations may also be performed with equipment 114 and 116 when shuttle 62 is passing along the central portion of track 123.

Equipment 114 and 116 may include, for example, equipment for applying heat, laser equipment, cutting equipment, knot formation equipment, soldering tools, etc. Equipment 114 may be used to load fresh bobbins and fresh magazines of electrical components into shuttle 62, may be used to recharge an energy storage device in shuttle 62, may be used to solder components to conductive strands of material that shuttle 62 has brought into alignment with equipment 114, and/or may be used in otherwise processing the strands of material in fabric 60. Equipment 116 may be used in mounting electrical components and otherwise processing warp and weft strands. As shown in FIG. 3, equipment 116 may include positioner 118 and tool 120. Tool 120 may be a laser for applying laser light, a hot bar, heated air source, or other soldering tool, a cutter, a knot forming tool, or other equipment for processing strands in fabric 60. Equipment 116 may, if desired, move tool 120 to location 122 to supply heated air to solder paste in location 122, thereby forming solder joints (e.g., to solder conductive strands to electrical component contacts). If desired, tool 120 may perform other operations (e.g., laser welding, laser removal of plastic or other material, etc.).

Figure 4:
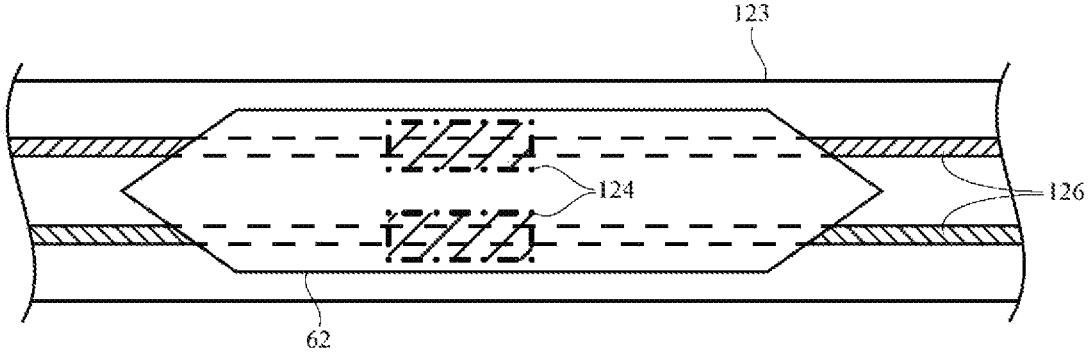
FIG. 4 is a view of an illustrative shuttle with electrical contacts that are coupled to a signal bus for providing power and data to the shuttle in accordance with an embodiment.

FIG. 4 is a diagram showing how shuttle 62 may have contacts such as contacts 130 that mate with respective signal lines 132 in track 123. During operation, contacts 130 may slide along the surface of lines 132 while remaining shorted to lines 132. In this way, lines 132 may be used to supply power signals (e.g., positive and ground power supply voltages) and/or communications signals (e.g., data). As an example, a controller in weaving equipment 22 may supply control signals to shuttle 62 via contacts 124 and/or power may be supplied to shuttle 62 via contacts 124. Wireless power and/or wireless data may also be transmitted and received by shuttle 62.

Figure 5:
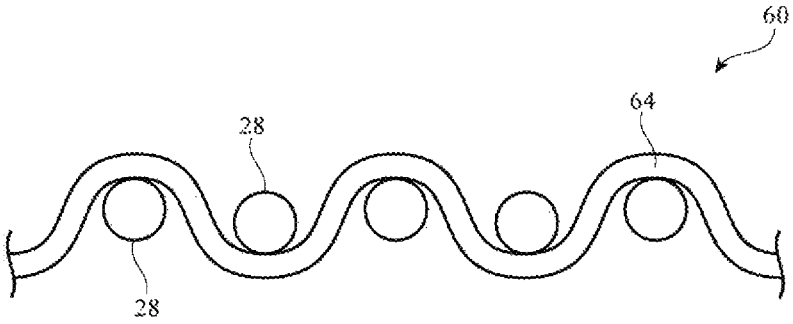
FIG. 5 is a cross-sectional side view of illustrative woven fabric in accordance with an embodiment.

Strands in fabric 60 may be intertwined using any suitable weaving technique. FIG. 5 is a cross-sectional side view of a portion of fabric 60 in a configuration in which a plain weave has been used in forming fabric 60. As shown in FIG. 5, fabric 60 may have warp fibers 28 and perpendicularly extending weft fibers 64. Fabric 60 may have a plain weave, a basket weave, or other suitable woven construction. If desired, fabric 60 may be a three-dimensional fabric (e.g., a spacer fabric) or other woven fabric.

Figure 6:
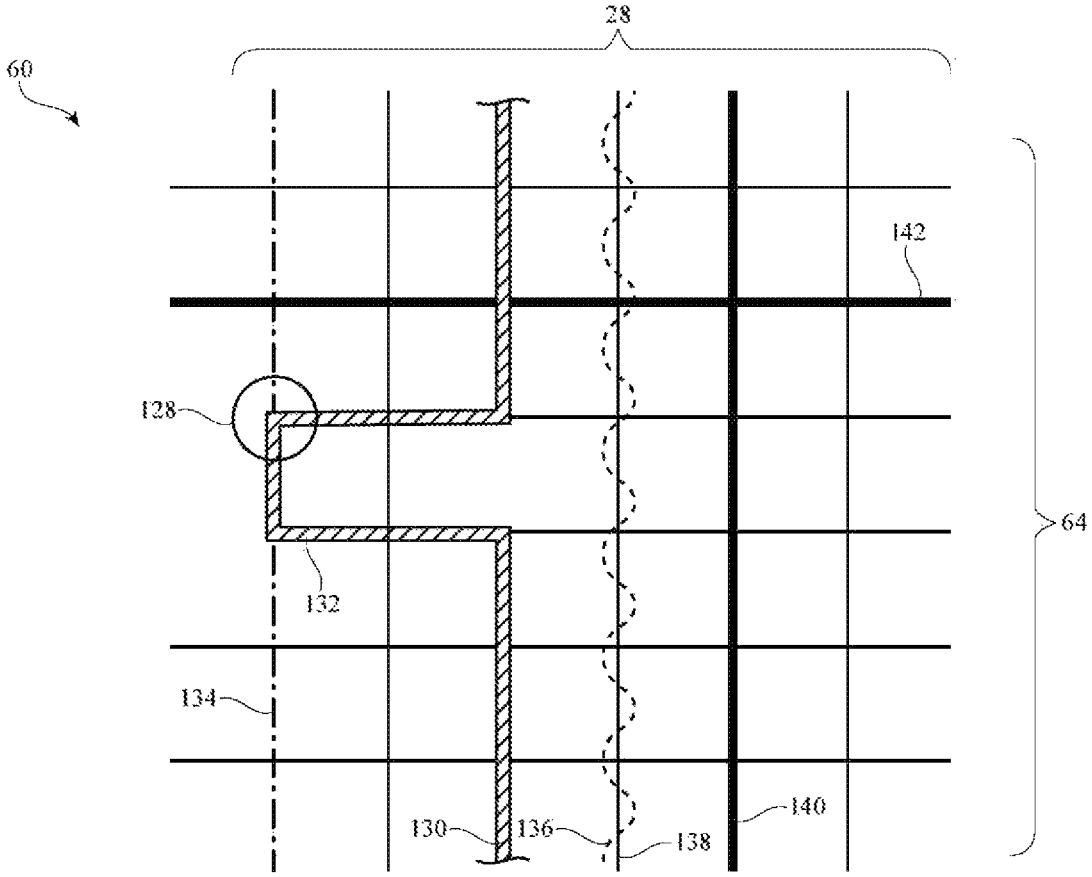
FIG. 6 is a top view of a portion of a woven fabric in accordance with an embodiment.

Warp strands 28 and weft strands 64 may include insulating strands and conductive strands. For example, fabric 60 may include conductive strands such as conductive warp strand 140 and conductive weft strand 142, as shown in FIG. 6. Solder or other conductive material may be used to couple strands such as strands 140 and 142 together and/or may be used to couple strands such as strands 140 and 142 to respective contacts on an electrical component.

Shuttle 62 may be used to route segments of warp strands through fabric 60 parallel to weft strands 64. For example, warp strand 130 may have a portion such as segment 132 that has been routed horizontally parallel to weft fibers 64. Warp strand 130 and warp strand 134 may be conductive. An electrical component in a region such as region 128 may have a first contact that is coupled to segment 132 of warp strand 130 and may have a second contact that is coupled to warp strand 134 (as an example).

If desired, strands in fabric 60 may be intertwined (e.g., by shuttle 62) using twisting, braiding, or other strand intertwining techniques. Twisted pairs of conductive strands (or intertwined conductive strands in a braided set of strands) may be used in carrying control signals or other signals and may be less susceptible to interference than untwisted strands. In the example of FIG. 6, strand 136 has been twisted about strand 138 by repetitive back and forth movement of shuttle 62 while moving warp strand 138 up and down with a heddle. Strands 136 and 138 may be conductive.

One or more shuttles (e.g., shuttle 62, etc.) may be used to form fabric 60 in equipment 22. Fabric 60 may have any suitable pattern of insulating and/or conductive strands of material, may have any suitable pattern of coupled electrical components, may have any suitable pattern of horizontally routed warp fiber segments, may have cut strands, soldered strands, strands that have portions that are stripped of insulation, and/or other structures. The configuration of fabric 60 in FIG. 6 is merely illustrative.

Figure 7:
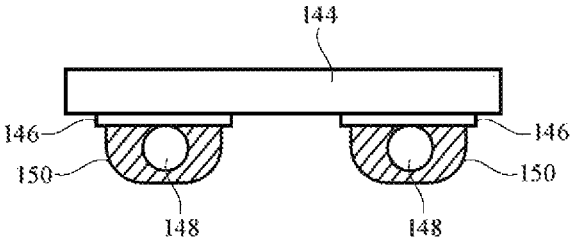
FIGS. 7 and 8 are side views of illustrative electrical components coupled to conductive strands of material in a fabric in accordance with an embodiment.
Figure 8:
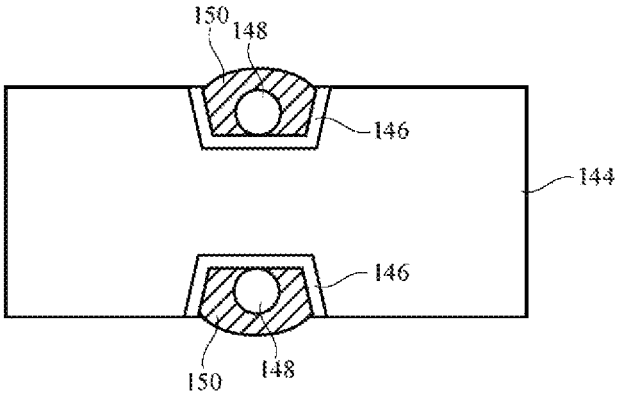

Electrical connections between electrical components and conductive strands of material in fabric 60 may be made using crimped contacts, welded contacts, or other suitable conductive connection structures. As an example, electrical components in fabric 60 may have two or more metal contact pads (contacts) and may be electrically shorted to respective conductive strands in fabric 60 using two or more respective solder joints. FIG. 7 is a cross-sectional side view of an illustrative electrical component that has been soldered to conductive strands. As shown in FIG. 7, electrical component 144 may have a pair of contacts 146 (e.g., metal solder pads). Conductive strands 148 may be coupled to contacts 146 using solder 150. In the illustrative configuration of FIG. 7, contacts 146 are both formed on the lower surface of component 144. If desired, contacts 146 may be formed on opposing sides of component 144 (see, e.g., FIG. 8).

Figure 9:
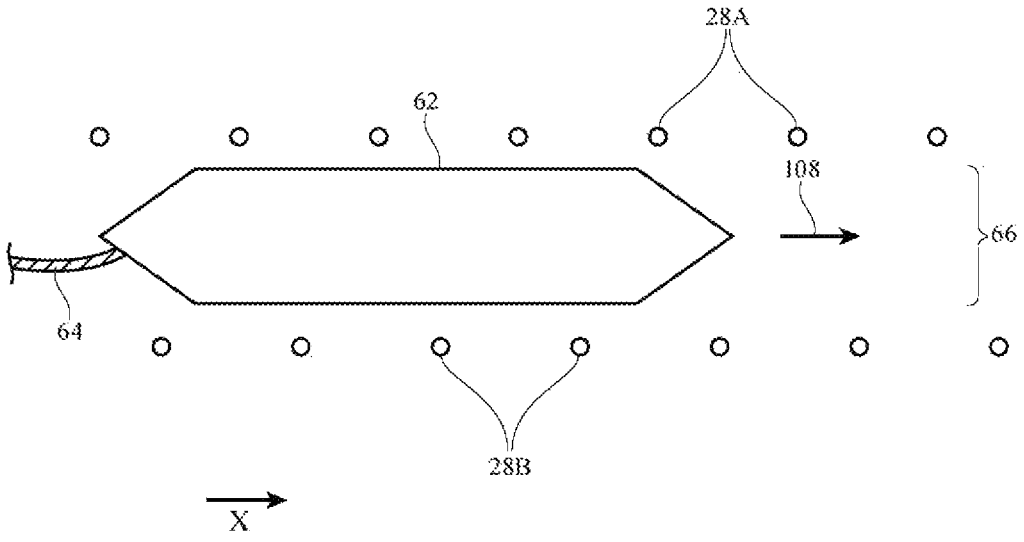
FIG. 9 is a side view of an illustrative shuttle as the shuttle is moving through a shed formed between two sets of warp strands in a weaving machine in accordance with an embodiment.

FIG. 9 shows how shuttle 62 may move parallel to axis X in direction 108 to dispense weft strand 64 in shed 66. In the illustrative configuration of FIG. 9, shed 66 has been formed between opposing upper and lower sets of warp strands 28 (i.e., between upper set of warp strands 28A and lower set of warp strands 28B). Heddles 36 may be used to move warp strands 28A into position above shuttle 62 and to move warp strands 28B into position below shuttle 62 before shuttle 62 passes through shed 66.

Shuttle 62 may have grippers and/or other components that process warp strands and other strands of material. If it is desired to grip or otherwise manipulate certain warp strands, heddles 36 may be adjusted to move those particular strand(s) into the path of shuttle 62 (e.g., into the path of an electrically controllable component such as a gripper).

Figure 10:
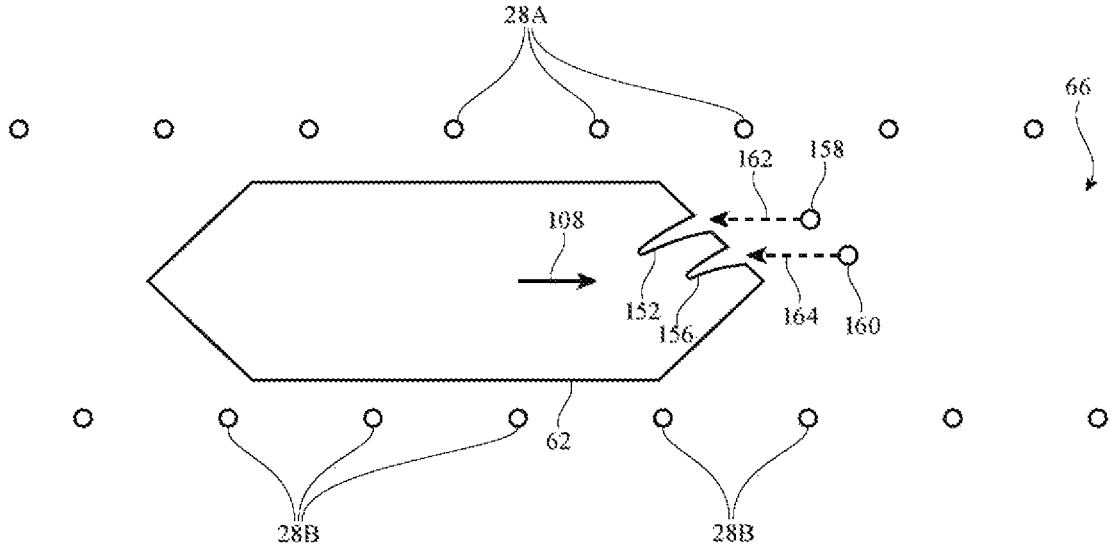
FIG. 10 is a side view of an illustrative shuttle with recesses for capturing and temporarily gripping warp strands in accordance with an embodiment.

Consider, as an example, illustrative shuttle 62 of FIG. 10. The body of shuttle 62 may be formed from materials such as plastic, metal, and/or other materials. As shown in FIG. 10, the body (housing) of shuttle 62 may have recesses such as grooves 152 and 156. Grooves 152 and 156 may have tapered profiles or other shapes that are configured to receive warp strands such as strands 158 and 160. Before shuttle 62 is moved across the warp strands in equipment 22, heddles 36 may move warp strands 28A above shuttle 62 and may move warp strands 28B below shuttle 62 to form shed 66. One of heddles 36 may move strand 158 into alignment with groove 152 and another of heddles 36 may move strand 160 into alignment with groove 156. When shuttle 62 is moved in direction 108, warp strand 158 will be received within groove 152 along path 162 and warp strand 160 will be received within groove 156 along path 164. Grooves 152 and 156 may then grip strands 158 and 160 while shuttle 62 is moved further in direction 108 (e.g., to pull strands 158 and 160 parallel to the weft strands 64).

Figure 11:
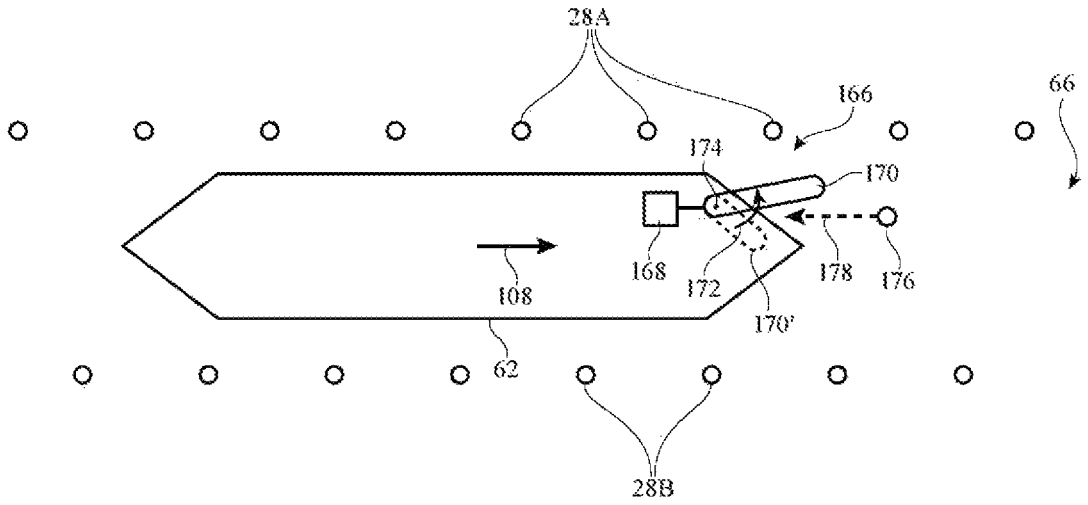
FIG. 11 is a side view of an illustrative shuttle with an electrically controllable gripper having a pivoting gripper arm in accordance with an embodiment.

If desired, shuttle 62 may be provided with an electrically controlled gripper device such as gripper 166 of FIG. 11. As shown in FIG. 11, gripper 166 may have a movable gripper arm such as pivotable arm 170. Gripper arm actuator 168 may rotate arm 170 in direction 172 about pivot 174 when it is desired to grip a warp fiber such as warp fiber 176. This moves arm 170 from position 170' within shuttle 62 to the deployed position shown in FIG. 11. Heddles 36 may be used to position warp strands 28A above shuttle 62 and to position warp strands 28B below shuttle 62 to form shed 66 before moving shuttle 62 in direction 108. One of the heddles 36 may be used to position warp strand 176 in alignment with arm 170, so that warp strand 176 is gripped by arm 170 along path 178 when shuttle 62 is moved in direction 108. If desired, actuator 168 may be used to close arm 170 on top of warp strand 176 to help firmly hold strand 176 as shuttle 62 is moved.

Figure 12:
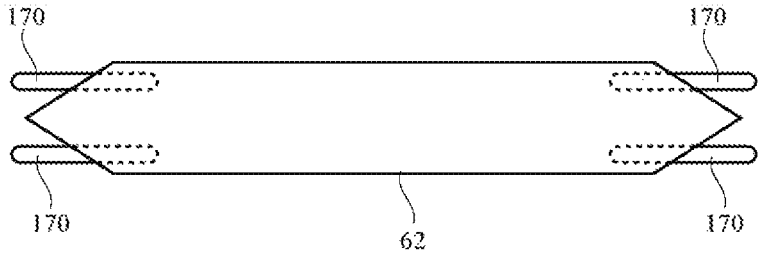
FIG. 12 is a side view of an illustrative shuttle having multiple gripper arms in accordance with an embodiment.

FIG. 12 is a side view of shuttle 62 in an illustrative configuration in which shuttle 62 has multiple grippers each with a respective adjustable-position actuator-controlled arm 170. Arms 170 in FIG. 12 have all been extended outwardly from the body of shuttle 62. When not in use, arms 170 may be retracted into or against the body of shuttle 62. The body of shuttle 62 may be formed from plastic, metal, and/or other materials.

Figure 13:
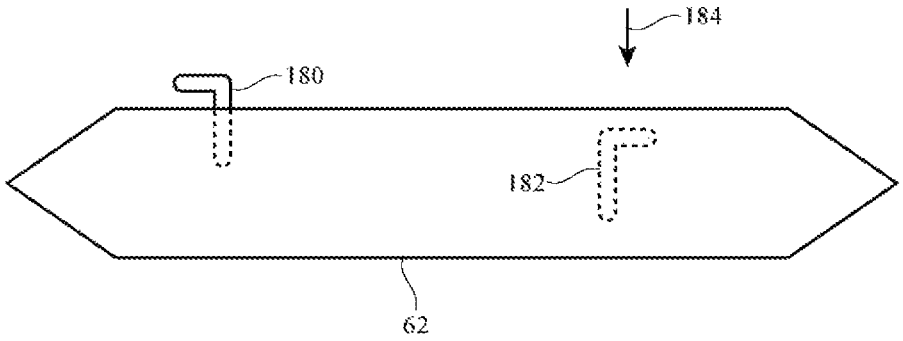
FIG. 13 is a side view of an illustrative shuttle with vertically deployable grippers in accordance with an embodiment.

FIG. 13 shows how shuttle 62 may be provided with extendable arms such as illustrative vertically extendable L-shaped arm 180. The position of L-shaped arm 180 and other movable members in shuttle 62 may be controlled using electrically controlled actuators (see, e.g., actuators 100 of FIG. 1). Actuators 100 and other electrically controllable devices in shuttle 62 may be controlled by control signals from control circuitry 90. Illustrative arm 180 has been deployed in the example of FIG. 13. Illustrative arm 182 in the example of FIG. 13 has been retracted into the body of shuttle 62 in direction 184. If desired, arms may be partially retracted to help hold in place any strands of material that have been captured by the hook-shaped tips of the arms.

Figure 14:
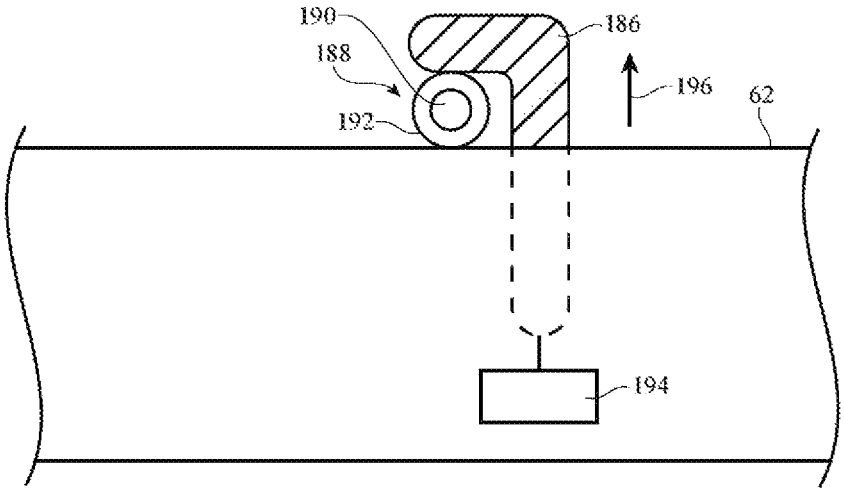
FIG. 14 is a side view of an illustrative shuttle with a heated gripper member in accordance with an embodiment.

In the illustrative configuration of FIG. 14, shuttle 62 has movable hook-shaped arm 186. Arm 186 may be controlled using circuitry 194. Circuitry 194 may be controlled by control signals from control circuitry 90. Circuitry 194 may include an actuator for positioning arm 186. The actuator may, for example, raise arm 186 out of the housing of shuttle 36 in direction 196 when it is desired to capture warp strand 188. Circuitry 194 may also include an ohmic heater or other heater element for heating arm 186.

Strand 188 may be a conductive strand having metal core 190 and polymer insulating coating 192. When strand 188 is captured by arm 186 as shown in FIG. 14, heat from arm 186 may be used to selectively remove insulating coating 192 from a portion of core 190 (e.g., by melting, etc.). In general, heating elements may be incorporated into any suitable portion of shuttle 62 (e.g., at the ends of grooves 152 and 156 in FIG. 10, in or adjacent to arm 170 of FIG. 12, within arms with hooks, etc.).

Figure 15:
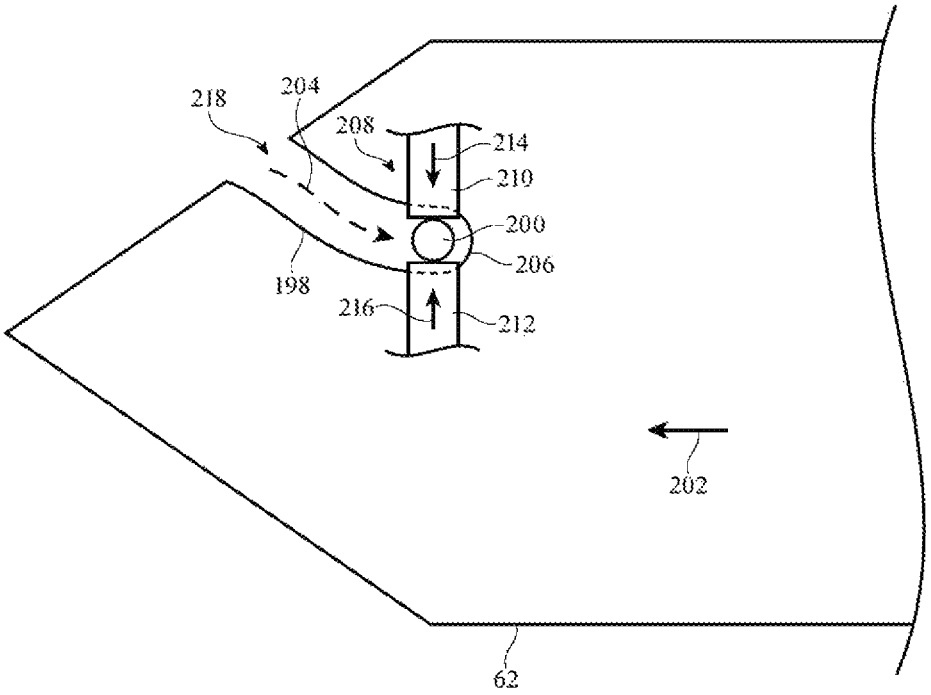
FIG. 15 is a side view of an illustrative shuttle with a cutter in accordance with an embodiment.

FIG. 15 shows how a cutter may be formed at the bottom of a groove that receives a warp fiber. As shown in FIG. 15, shuttle 62 may have a groove such as groove 196. A heddle may move warp strand 200 into alignment with opening 218 of groove 198, so that strand 200 is guided to end 206 of groove 198 when shuttle 62 is moved in direction 202. Cutter 208 may have upper cutter blade 210 and corresponding lower cutter blade 212. After strand 200 has been received within groove 198 and is being held at end 206 of groove 198, blade 210 may be moved downwardly in direction 214 and/or blade 212 may be moved upwardly in direction 216 by one or more electrically controlled actuators in shuttle 62 to cut strand 200. After cutting, a knot may be formed to attach the cut end of strand 200 to another strand of material in fabric 60, the cut end of strand 200 may be soldered or otherwise coupled to a contact on an electrical component, etc.

Figure 16:
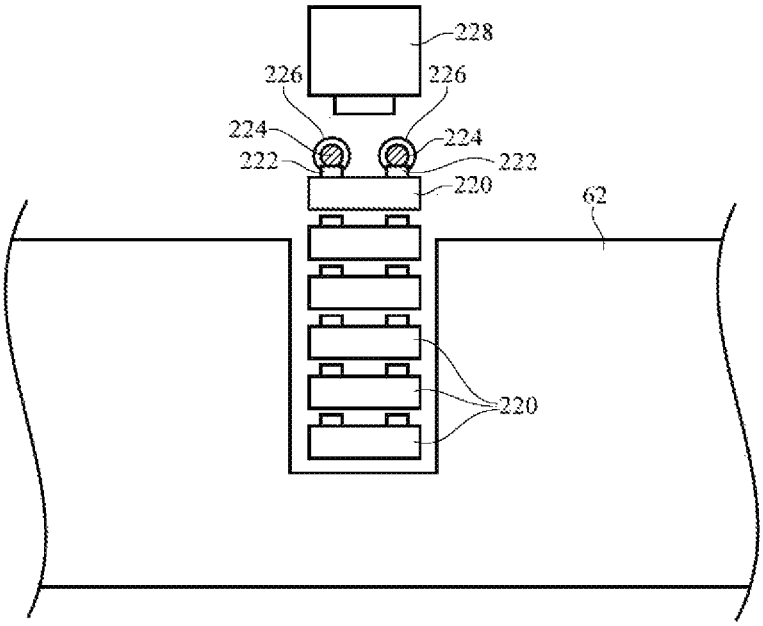
FIG. 16 is a side view of an illustrative shuttle that dispenses electrical components for attachment to strands of material in a fabric in accordance with an embodiment.

As shown in FIG. 16, shuttle 62 may, if desired, contain a reservoir of electrical components such as components 220. Components 220 may be dispensed from a length of tape, from a replaceable magazine of stacked components, or from other suitable component sources in shuttle 62. Each component 220 may have contacts such as contacts 222 and may be coupled to conductive strands in fabric 60. As an example, conductive warp strands 224 may be soldered to contacts 22 using solder 226. Heating tool 228 (e.g., an inductive heater, a heater that produces laser light or hot air for heating solder 226, or other suitable heater) may be used to solder strands 224 to contacts 222.

Figure 17:
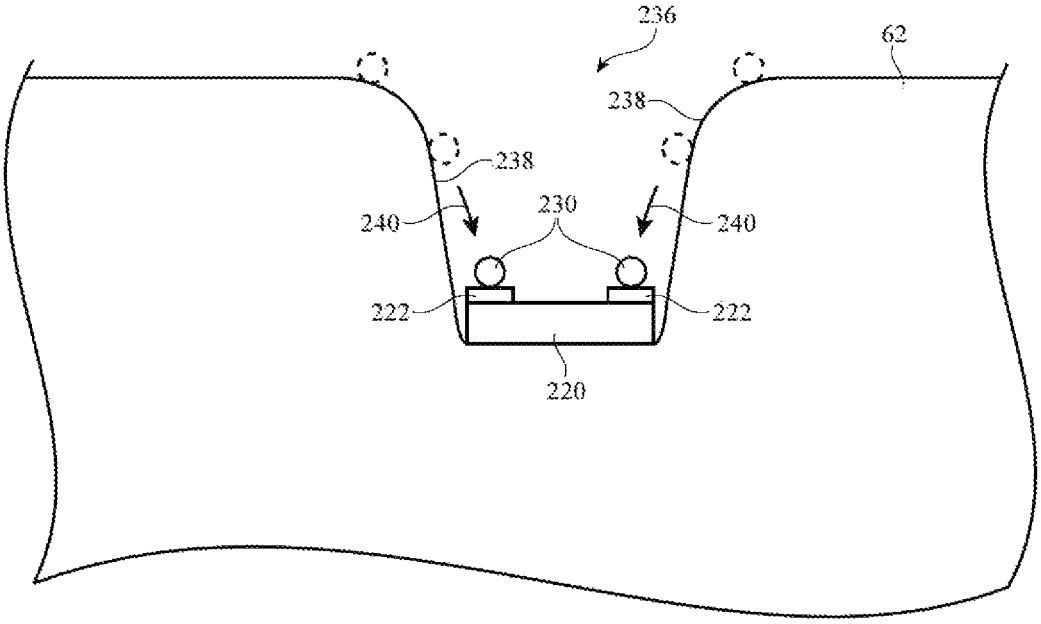
FIG. 17 is a side view of an illustrative shuttle cavity with sidewalls having a curved profile to guide warp strands into alignment with electrical component contacts in accordance with an embodiment.

In the example of FIG. 17, conductive warp strands 230 have been received within recess 236 of the housing of shuttle 62. Component 220 has contacts 222 and is positioned at the bottom of recess 236. Movement of heddles 36 and/or movement of shuttle 62 may be used to cause strands 230 to be guided along sloped inner sidewalls surfaces 238 in directions 240 onto contacts 222 on component 220. After conductive warp strands 230 of other conductive strands have been aligned with contacts 222 as shown in FIG. 17, a source of hot air, a heated metal member, a laser, an inductive heater, or other electrically controllable soldering device may be used to solder strands 230 to contacts 222. Heddles 36 may then be moved to release component 220 from recess 236.

If desired, shuttle 62 may dispense intertwined strands of material (e.g., intertwined weft strands, intertwined strands that have segments that are routed parallel to weft strands 64 and that have segments that are routed parallel to warp strands twisted strands of material (e.g., twisted pairs of conductive strands). To produce intertwined strands such as these, shuttle 62 may be provided with a strand braising device, a strand twisting device, or other strand intertwining device.

Figure 18:
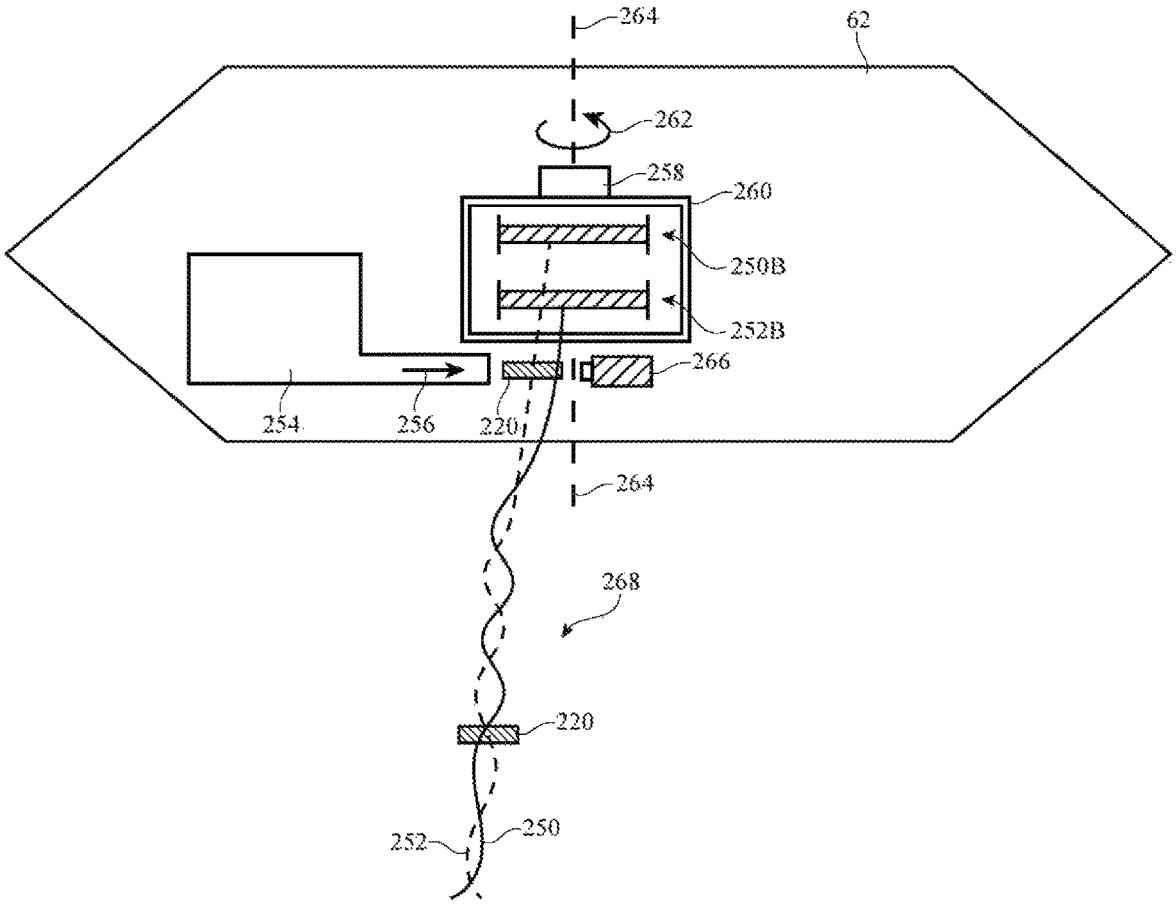
FIG. 18 is a side view of an illustrative shuttle having spinning bobbins and component attachment equipment for dispensing twisted strands of material with attached components in accordance with an embodiment.

As shown in FIG. 18, for example, shuttle 62 may have a source of multiple strands such as first strand bobbin 252B for dispensing first strand 252 and second strand bobbin 250B for dispensing second strand 250. Bobbins 250B and 252B may be mounted in bobbin housing 260. Motor 258 may be used to rotate housing 260 in direction 262 about rotational axis 264, thereby twisting strands 250 and 252 about each other as strands 250 and 252 are being dispensed by shuttle 62. If desired, components may be mounted to strands 250 and 252 during strand dispensing. As shown in FIG. 18, components such as electrical component 220 may be dispensed onto strands 250 and 252 in direction 256 from component dispenser 254 (e.g., a tape with components, a stacked magazine containing components, etc.). Soldering device 266 may produce heat (e.g., hot air, light, etc.) that solders contacts on components 220 to strands 250 and 252. Twisted strand pair 268 may serve as weft strands 64 in fabric 60, may have portions that are wrapped around warp strands (see, e.g., wrapped strand 136 of FIG. 6), may have segments that run perpendicular to warp strands and segments that run parallel to warp strands, etc.

Figure 19:
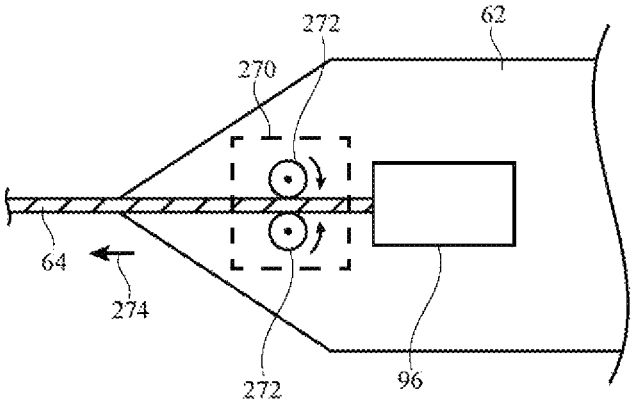
FIG. 19 is a side view of an illustrative shuttle having a strand dispenser that can perform tasks such as strand metering and/or strand tensioning in accordance with an embodiment.

Shuttle 62 may contain an electronically controlled strand dispenser such as strand dispenser 270 of FIG. 19. Strand dispenser 270 may have sensors and motors that measure and adjust the amount of strand 64 that is dispensed from shuttle 62. In the example of FIG. 19, strand 64 is being dispensed in direction 274. Sensors and actuators in dispenser 270 may be coupled to rotating structures such as wheels 272 and may be coupled to control circuitry 90. By measuring the amount (i.e., the length) of strand 64 dispensed in direction 274 per unit time (or per pass through shed 66 or per other suitable unit of time, distance, etc.) control circuitry 90 and supplied control signals to dispenser 270 that adjust the dispensing of strands 64 so as to prevent over-tensioning and under-tensioning of strand 64, thereby avoiding the production of uneven areas in fabric 60. Wheels 272 or other dispensing structures in dispenser 274 may meter out particular amounts of strand 64, may measure and/or adjust strand tension, may measure and/or adjust strand velocity, and/or may otherwise monitor and adjust the dispensing of strands of material from shuttle 62.

Figure 20:
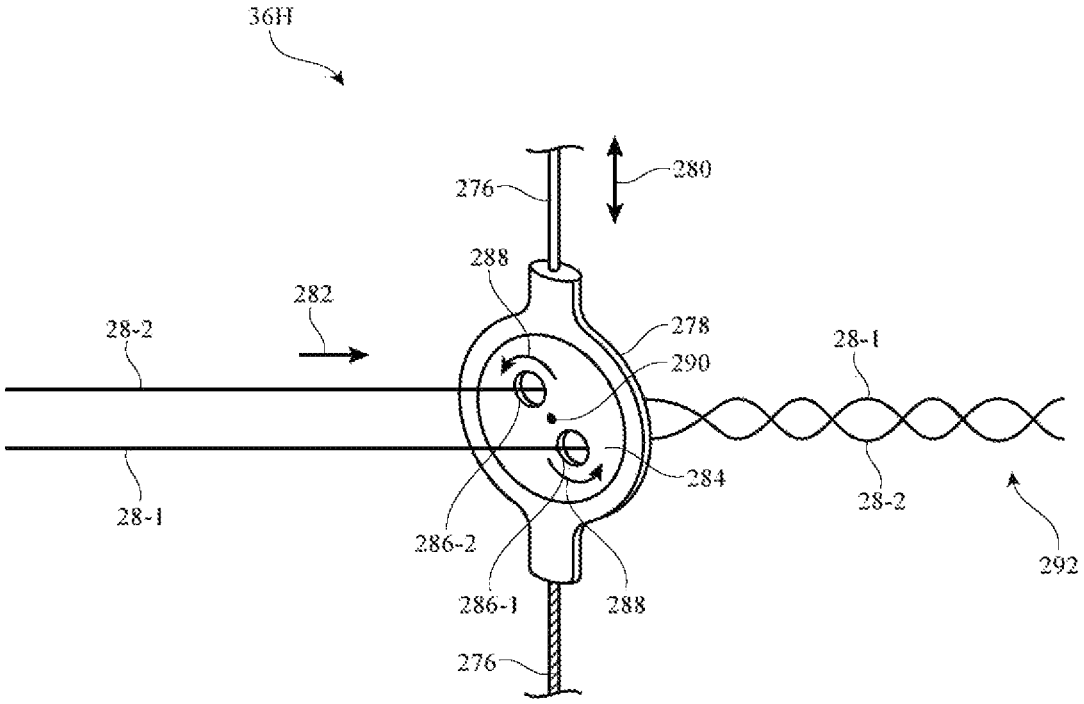
FIG. 20 is a side view of an illustrative heddle with spinning eyes for twisting warp strands together in accordance with an embodiment.

FIG. 20 is a perspective view of an illustrative heddle with a rotating disk with multiple eyes. As shown in FIG. 20, heddle 36H has a wire such as wire 276 that is coupled to heddle disk housing 278. Wire 276 may be moved up and down in directions 280 using positioners 42 (FIG. 1). Heddle disk 284 may be rotated in directions 288 about rotational axis 290 by a motor or other actuator in heddle disk housing 278. Heddle disk 284 may have a first opening such as eye 286-1 that receives a first warp strand such as stand 28-1 and may have a second opening such as eye 286-2 that receives a second warp strand such as strand 28-2. As strands 28-1 and 28-2 move through heddle 36H in direction 282, disk 284 rotates and twists strands 28-1 and 28-2 about each other as shown by twisted warp strands 292. Twisted warp strands 292 may be woven into fabric 60 with other warp strands 28, as described in connection with FIG. 1.

The foregoing is merely illustrative and various modifications can be made to the described embodiments. The foregoing embodiments may be implemented individually or in any combination.

What is claimed is:

1. An electronically controllable shuttle that is configured to dispense an amount of a weft strand while passing through warp fibers in weaving equipment, comprising:

control circuitry; and an electronically controlled weft strand dispenser that is coupled to the control circuitry and that is configured to control the amount of the weft strand that is dispensed.

2. The electronically controllable shuttle defined in claim 1 wherein the weft strand dispenser is configured to monitor the amount of weft strand that is dispensed.

3. The electronically controllable shuttle defined in claim 1 further comprising:

a component dispenser configured to provide electrical components; and a soldering device configured to receive control signals from the control circuitry and configured to solder the electrical components to the weft strand.

4. The electrically controllable shuttle defined in claim 3 further comprising at least one groove that is configured to receive one of the warp fibers during weaving with the weaving equipment.

5. The electronically controllable shuttle defined in claim 1 wherein the weaving equipment comprises a heddle with a rotating structure that twists at least two of the warp fibers as the weft strand is dispensed by the electronically controlled weft strand dispenser.

6. A weaving shuttle for forming fabric having strands of material, wherein the strands of material include weft strands and warp strands, and wherein the weaving shuttle dispenses the weft strands while passing by the warp strands as the shuttle moves back and forth in a shuttle track in a shuttle support structure in weaving equipment, the weaving shuttle comprising:

control circuitry; and an electrically adjustable device coupled to the control circuitry, wherein the adjustable device processes at least one of the strands of material in response to control signals from the control circuitry.

7. The weaving shuttle defined in claim 6 wherein the electrically adjustable device comprises an actuator.

8. The weaving shuttle defined in claim 6 the electrically adjustable device comprises a cutter that is configured to cut the strands of material.

9. The weaving shuttle defined in claim 6 wherein the electrically adjustable device comprises a heater that is configured to apply heat to the strands of material.

10. The weaving shuttle defined in claim 6 further comprising a shuttle housing having at least one groove that is configured to receive the at least one of the strands of material as the shuttle moves in the shuttle track.

11. The weaving shuttle defined in claim 6 further comprising a soldering device that is configured to solder electrical components to conductive strands within the strands of material.

12. The weaving shuttle defined in claim 6 further comprising wireless communications circuitry coupled to the control circuitry.

13. An electronically controllable fabric weaving shuttle that is configured to dispense a length of a weft strand while passing through warp strands in weaving equipment, comprising:

control circuitry; and an electronically controlled weft strand dispenser that is coupled to the control circuitry and that is configured to adjust the length of the weft strand that is dispensed.

14. The electronically controllable fabric weaving shuttle of claim 13 further comprising:

a movable gripper; and an actuator that is configured to move the gripper in response to control signals from the control circuitry.

15. The electronically controllable fabric weaving shuttle defined in claim 14 wherein the movable gripper has an arm that is configured to rotate.

16. The electronically controllable fabric weaving shuttle defined in claim 14 wherein the movable gripper comprises an extendable arm with a hook.

17. The electronically controllable fabric weaving shuttle defined in claim 13 further comprising:

communications circuitry coupled to the control circuitry that receives communications signals from external equipment.

18. The electronically controllable fabric weaving shuttle defined in claim 13 further comprising a battery and wireless communications circuitry coupled to the control circuitry.

19. The electronically controllable fabric weaving shuttle defined in claim 13 further comprising contacts that are configured to mate with signal paths in a shuttle track.

20. The electronically controllable fabric weaving shuttle defined in claim 13 further comprising a pair of bobbins that dispense a pair of strands and wherein a motor twists the pair of strands by rotating the bobbins as the bobbins dispense the pair of strands.

21. The weaving shuttle defined in claim 6 wherein the adjustable device processes at least one of the warp strands in response to the control signals from the control circuitry.

* * * * *